US005482388A

United States Patent [19]

Harada

[11] Patent Number: 5,482,388

[45] Date of Patent: Jan. 9, 1996

[54] DETENT MECHANISM AND GEAR CHANGEOVER APPARATUS IN A RECORDING APPARATUS

[75] Inventor: Tsutomu Harada, Tokyo, Japan

[73] Assignee: Canon Kabushiki Kaisha, Tokyo, Japan

[21] Appl. No.: 352,159

[22] Filed: Dec. 2, 1994

Related U.S. Application Data

[63] Continuation of Ser. No. 248,539, May 24, 1994, abandoned, which is a continuation of Ser. No. 858,436, Mar. 24, 1992, abandoned, which is a continuation of Ser. No. 569,584, Aug. 20, 1990, abandoned, which is a continuation of Ser. No. 192,162, May 10, 1988, abandoned.

[30] Foreign Application Priority Data

May 28, 1987 [JP] Japan ..... 62-129961

[51] Int. Cl.[6] ..... B41J 23/32

[52] U.S. Cl. ..... 400/185; 400/225; 400/322; 400/568

[58] Field of Search ..... 400/185, 186, 400/187, 225, 229, 236.2, 320, 322, 328, 568, 569, 577, 902, 903; 346/134, 139 R, 139 A, 139 D; 347/215

[56] References Cited

U.S. PATENT DOCUMENTS

| | | | |
|---|---|---|---|
| 3,986,594 | 10/1976 | Kondur, Jr. | 400/185 |
| 4,303,345 | 12/1981 | Lada | 400/229 |
| 4,329,075 | 5/1982 | Applegate et al. | 400/229 |
| 4,376,585 | 3/1983 | Fromme et al. | 400/568 X |
| 4,383,778 | 5/1983 | Costa | 400/568 X |
| 4,606,663 | 8/1986 | Christoph et al. | 400/569 X |
| 4,699,534 | 10/1987 | Asakura et al. | 400/568 |
| 4,787,762 | 11/1988 | Arai | 400/187 |
| 4,976,557 | 12/1990 | Uchikata | 400/565 |

FOREIGN PATENT DOCUMENTS

| | | | |
|---|---|---|---|
| 0038216 | 10/1981 | European Pat. Off. | 400/568 |
| 0202039 | 11/1986 | European Pat. Off. | 400/185 |
| 0152881 | 8/1984 | Japan | 400/185 |
| 0158276 | 9/1984 | Japan | 400/568 |
| 60-18369 | 1/1985 | Japan . | |
| 60-18370 | 1/1985 | Japan . | |
| 002580 | 1/1986 | Japan | 400/187 |
| 0118283 | 6/1986 | Japan | 400/187 |
| 60-202868 | 9/1986 | Japan . | |
| 0205168 | 9/1986 | Japan | 400/185 |
| 0241178 | 10/1986 | Japan | 400/185 |

OTHER PUBLICATIONS

IBM Technical Disclosure Bulletin, "Electromechanical Variable–Index System", Klein et al, vol. 17 No. 4 Sep. 1974, pp. 959–960.

*Primary Examiner*—David A. Wiecking

*Attorney, Agent, or Firm*—Fitzpatrick, Cella, Harper & Scinto

[57] ABSTRACT

A recording apparatus having a paper feeding device for feeding a printing sheet, a detent mechanism capable of engaging the feed roller so as to determine the feeding pitch at which the paper feeding device feeds the sheet, a ribbon feeding mechanism for feeding an ink ribbon, a driving power source for generating a driving force, a transmission mechanism for transmitting a driving force from the driving power source to one of the paper feeding device and the ribbon feeding mechanism to operate the paper feeding device or the ribbon feeding mechanism, and a changeover mechanism for changing over the transmission effected by the transmission mechanism and also changing over the engagement between the detent mechanism and the paper feeding device in a linked relationship with the changeover of the transmission of the driving force.

30 Claims, 7 Drawing Sheets

DETENT MECHANISM AND GEAR CHANGEOVER APPARATUS IN A RECORDING APPARATUS

This application is a continuation of application Ser. No. 08/248,539, filed May 24, 1994, which is a continuation of application Ser. No. 07/858,436, filed Mar. 24, 1992, which is a continuation of application Ser. No. 07/569,584, filed Aug. 20, 1990, which is a continuation of application Ser. No. 07/192,162, filed May 10, 1988, now all abandoned.

BACKGROUND OF THE INVENTION

1. Field of the Invention

This invention relates to a recording apparatus and, more particularly, to a recording apparatus having a detent mechanism which operates to supply a recording sheet and an ink ribbon and which also serves as a driving power source.

2. Description of the Prior Art

Referring first to FIG. 5, a typewriter which is an example of this type of conventional recording apparatus is provided with a carriage 1 having a printing head and capable of accommodating an ink ribbon, and a printer mechanism 2 which includes a driving power source for feeding a sheet and the ribbon and a transmission mechanism for this operation.

FIG. 6 schematically illustrates details of the printer mechanism 2, including a motor 3, a clutch 4, a platen 5 for supplying a sheet and forming the printing surface, and a torque shaft 6 for transmitting power to feed the ink ribbon provided in the carriage 1. A gear 3A which is attached to a rotary shaft of the motor 3 meshes with a clutch gear 4A which is rotatably supported around a shaft 4C extending from the clutch 4. As the clutch gear 4A is moved in response to the movement of the clutch 4, it meshes with a torque shaft gear 14 or with a platen gear 12 which is connected to a rotary shaft 5B of the platen 5 coaxially therewith. A torque shaft pulley 6A which is connected to the torque shaft gear 14 coaxially therewith is engaged, via a belt 7, with a torque shaft pulley 6B which is connected to the torque shaft 6 coaxially therewith. The torque of the motor 3 is thereby transmitted to the torque shaft 6 or to the platen 5 by suitably changing over the clutch 4.

As the platen 5 rotates, a printing sheet 5A wound around the platen 5 is fed line by line. The ribbon on the carriage 1 is moved by the movement of the torque shaft 6 by any conventially known means. For example, a pair of bevel gears ay be used wherein a first bevel gear is arranged integrally with shaft 6 and a second bevel gear is arranged integrally with the ribbon winding shaft, the second bevel gear engaging the first bevel gear. Shaft 6 would rotate the first bevel gear which action rotates the second bevel gear to move the ribbon.

A solenoid 8 has a shaft 8A which is engaged with one end of a solenoid lever 13. The solenoid lever 13 is swingably supported at this end. The other end of solenoid lever 13 engages recess 4B of clutch 4. Therefore, the solenoid 8 can move the lever 13 and, hence, the clutch 4 by the axial movement of the shaft 8A, thereby selecting the portion to which the torque is transmitted.

FIG. 7 shows in perspective an example of a conventional detent mechanism. This mechanism is disposed at an end of the platen 5 in a position opposite to that of the printer mechanism 2 relative to this platen 5. The detent mechanism is constituted by a detent gear 10 coaxial with the shaft 5C of the platen 5, and a plate spring 9 capable of engaging with the detent gear 10.

The plate spring 9 has a bent end portion which engages with the detent gear 10 by entering one of root portions thereof. The movement of the platen 5 is limited by the urging force of the plate spring 9 so as to set the printing line pitch. As the platen 5 rotates to feed a sheet 5A, the detent gear 10 rotates and the bent end portion of the plate spring 9 climbs over a tooth of the gear 10 and enters in an adjacent root portion.

However, in a conventional arrangement, there is the problem of noise occurring when the plate spring 9 climbs over a tooth of the detent gear 10 at the time of sheet feeding, and a problem of inaccuracy of setting of the sheet feeding pitch due to a low accuracy of engagement between the bent end portion of the plate spring 9 and the detent gear 10.

SUMMARY OF THE INVENTION

It is an object of the present invention to provide a recording apparatus assembled from a reduced number of component parts and capable of eliminating the apparatus necessary for the detent function.

To this end, the present invention provides a recording apparatus having: a sheet supply means for feeding a recording sheet; a detent means capable of engaging with the sheet supply means so as to determine the feeding pitch at which the sheet supply means supplies the sheet; a ribbon supply means for supplying an ink ribbon; a driving power source for generating a driving force; a transmission means for transmitting a driving force from the driving power source to one of the sheet supply means and the ribbon supply means so as to actuate the sheet supply means or the ribbon supply means; and a changeover means for changing over the state of transmission effected by the transmission means and also changing over the state of engagement between the detent means and the sheet supply means in a linked relationship with the changeover of the state of transmission.

Other objects and features of the present invention will become clear upon reading the following description.

DESCRIPTION OF THE PREFERRED EMBODIMENT

The present invention will be described below in detail with reference to the accompanying drawings with respect to an embodiment thereof.

Figure 1:
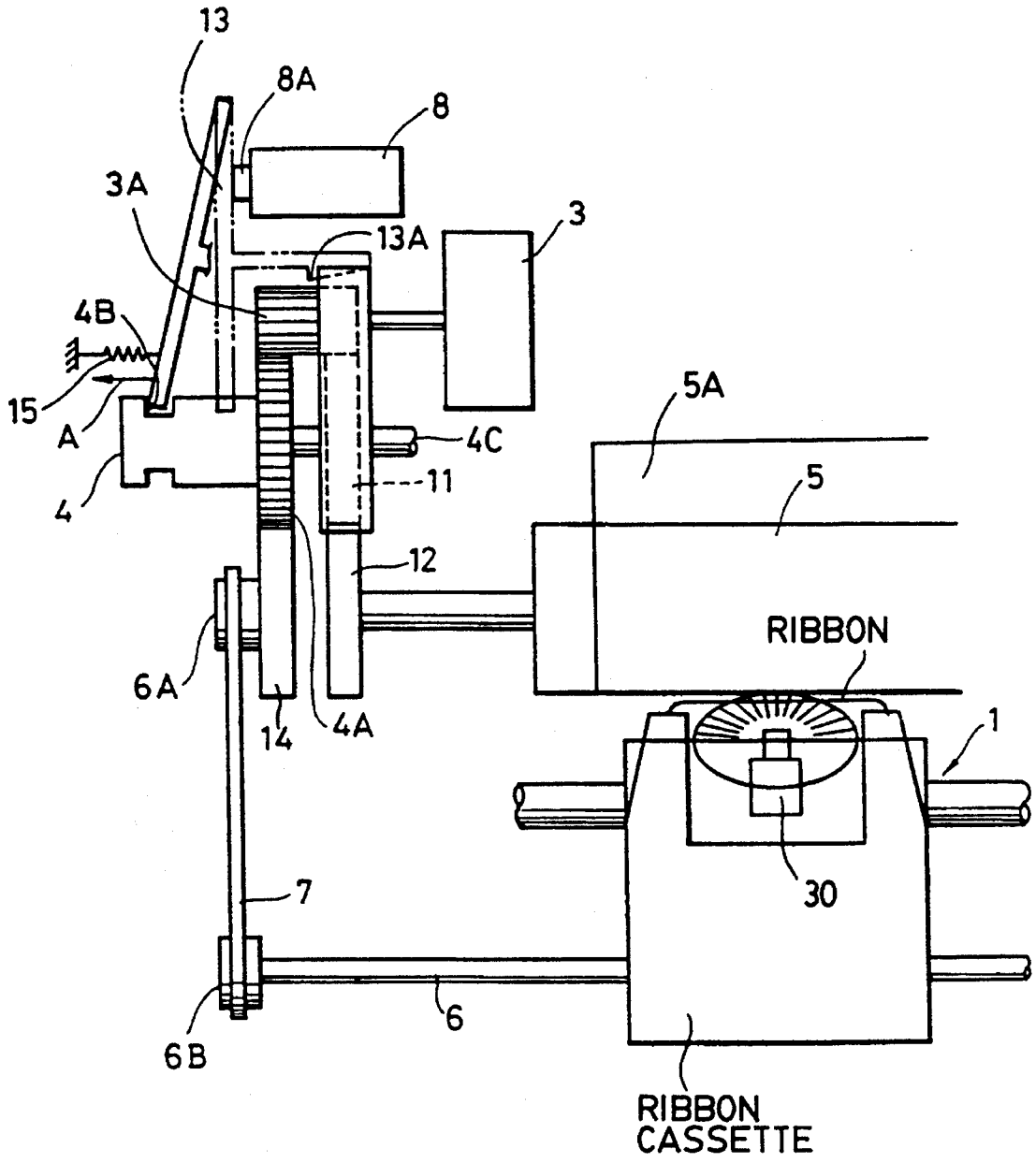
FIGS. 1 and 2 are a front view and a side view of a portion of an embodiment of the present invention.
Figure 2:
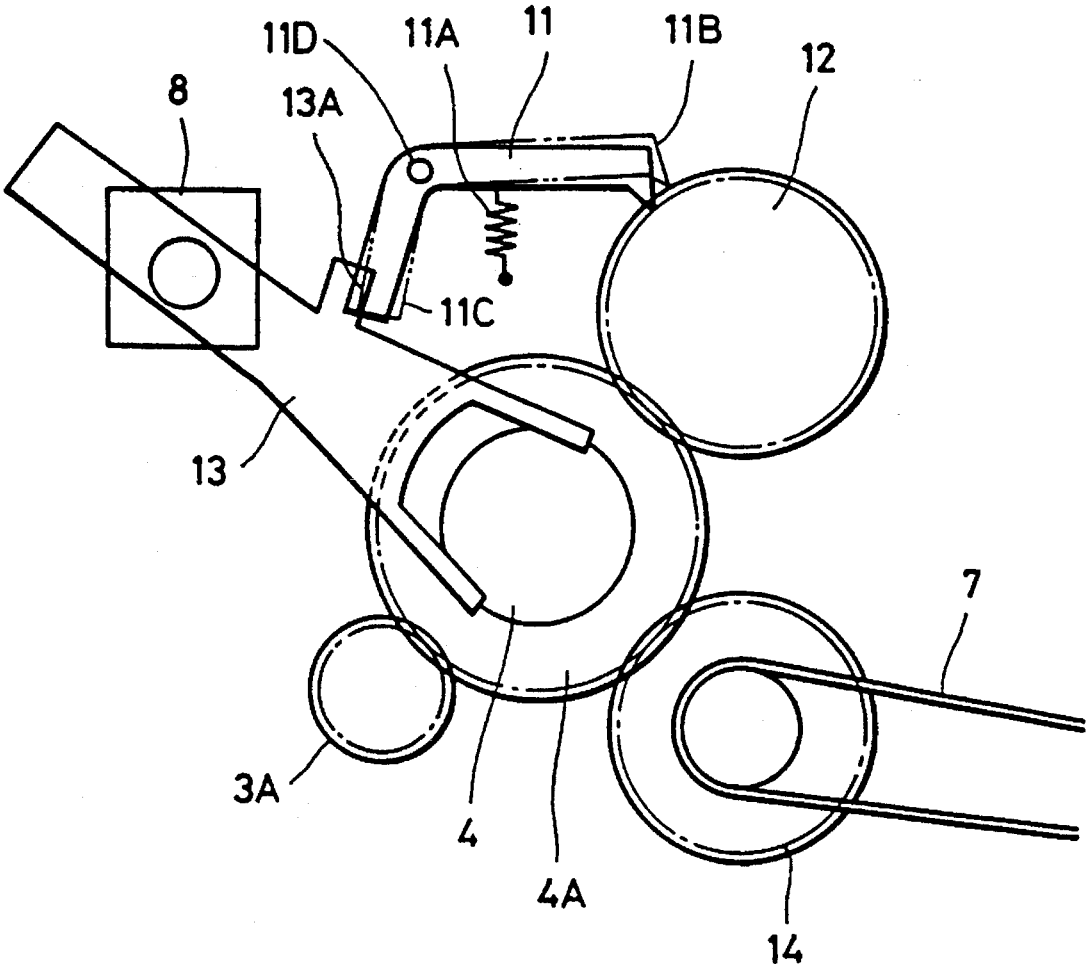

FIGS. 1 and 2 are front and side views of a mechanism in accordance with an embodiment of the present invention. Components identical to those shown in FIG. 6 are indicated by the same reference characters, and the description for them will not be repeated.

Figure 6:
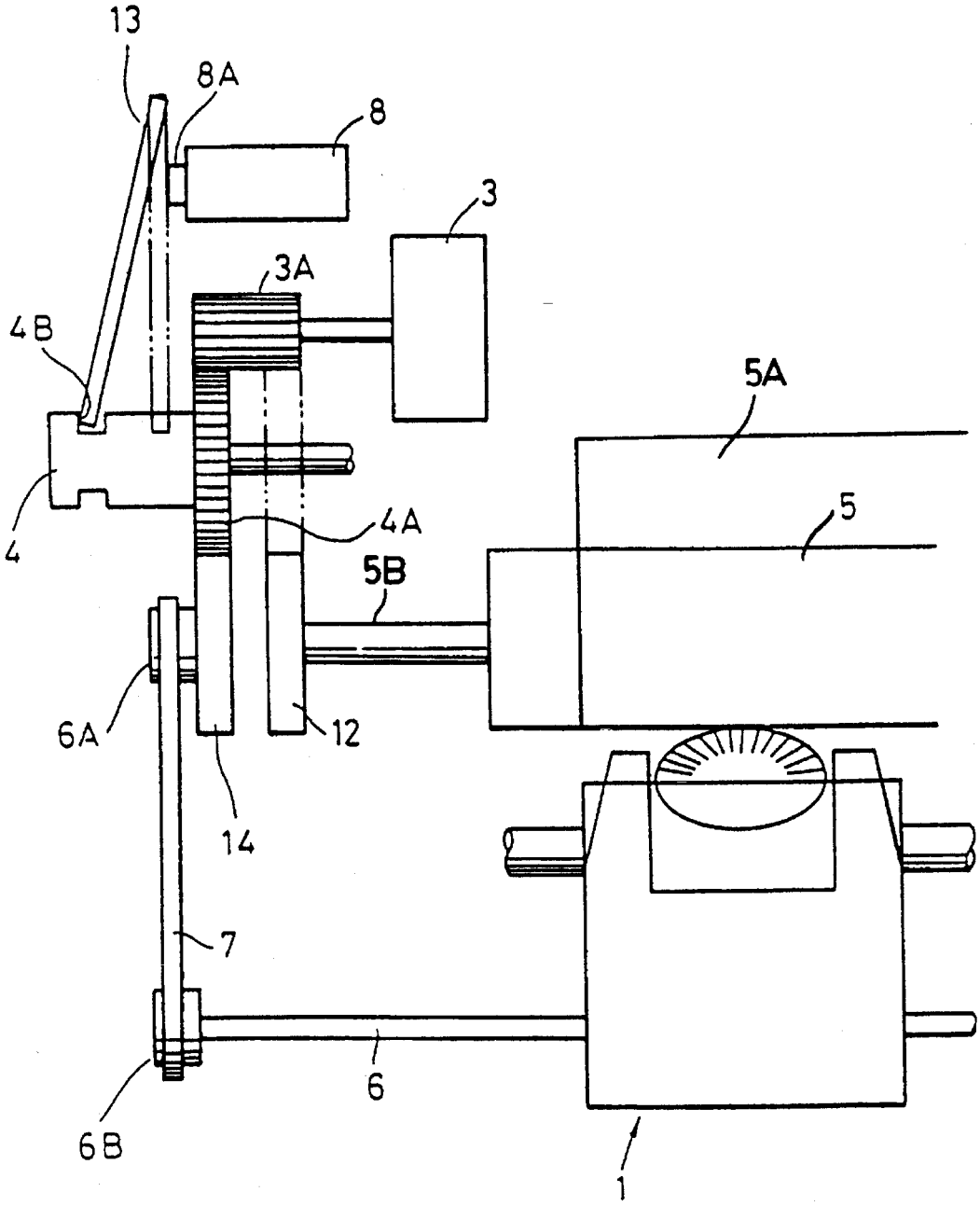
FIG. 6 (PRIOR ART)
FIG. 6 is a front view of an essential part of the example shown in FIG. 5.
Figure 7:
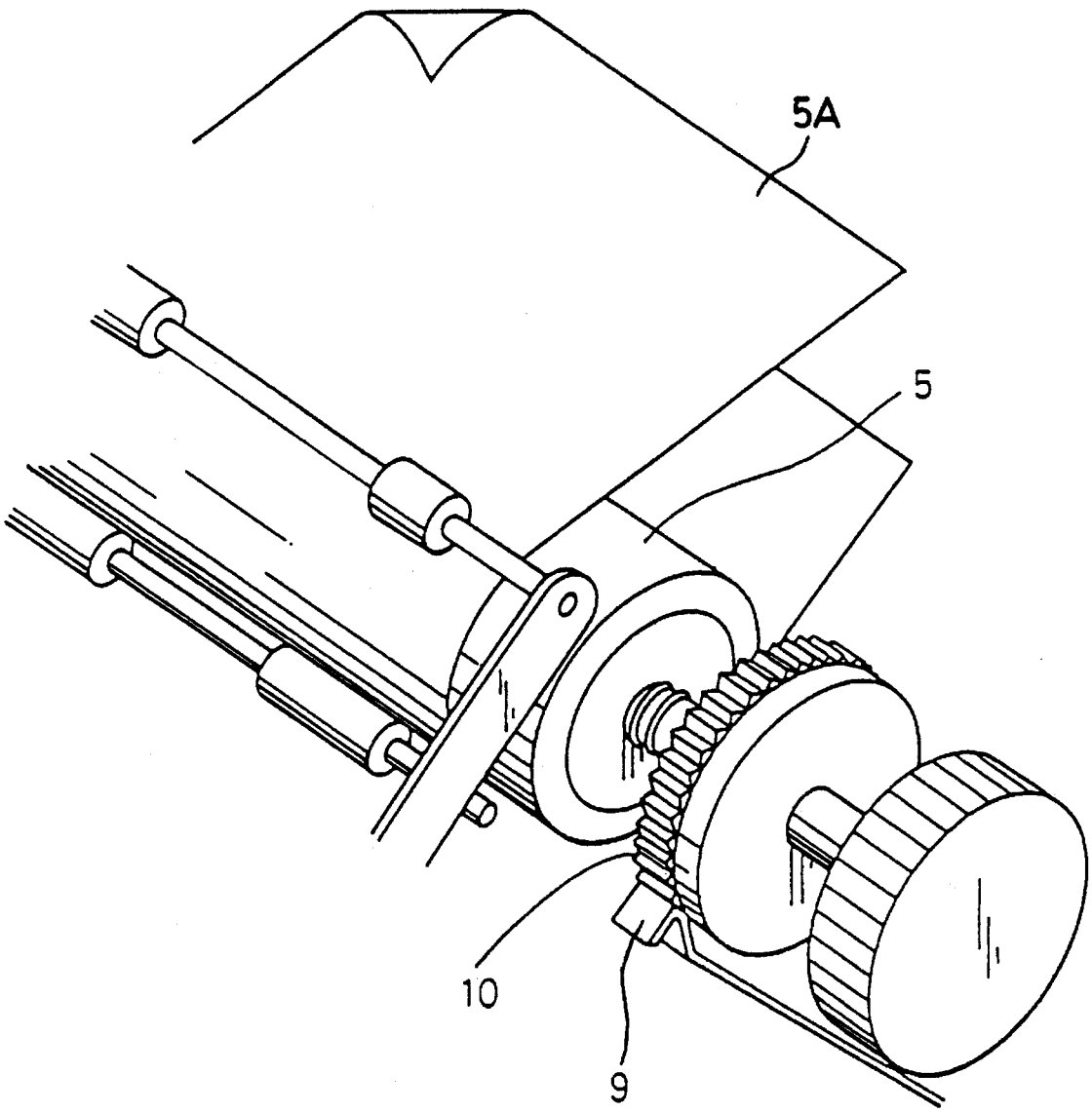
FIG. 7 (PRIOR ART)
FIG. 7 is a perspective view of a detent mechanism of the example shown in FIG. 5.

The difference between this embodiment and the conventional arrangement shown in FIGS. 6 and 7 resides in that, in this embodiment, a detent lever 11 is disposed between the solenoid lever 13 and the platen gear 12 instead of providing the plate spring 9 and the detent gear 10. The solenoid lever 13 is provided with a tapered portion 13A.

The detent lever 11 is supported generally at its center so that it can swing about pivot 11D. An end 11B of the detent lever 11 is wedge-shaped and is capable of engaging with the platen gear 12. The other end 11C of the detent lever 11 can be brought into contact with the tapered portion 13A formed on the solenoid lever 13. A spring 11A is attached to a suitable portion of the detent lever 11 so that it urges the detent lever 11 in the direction of engagement with the platen gear 12.

The solenoid lever 13 is constantly urged by a spring 15 in the direction indicated by the arrow A in FIG. 1. Therefore, when the solenoid 8 is de-energized, the clutch gear 4A meshes with the torque shaft gear 14.

Figure 3:
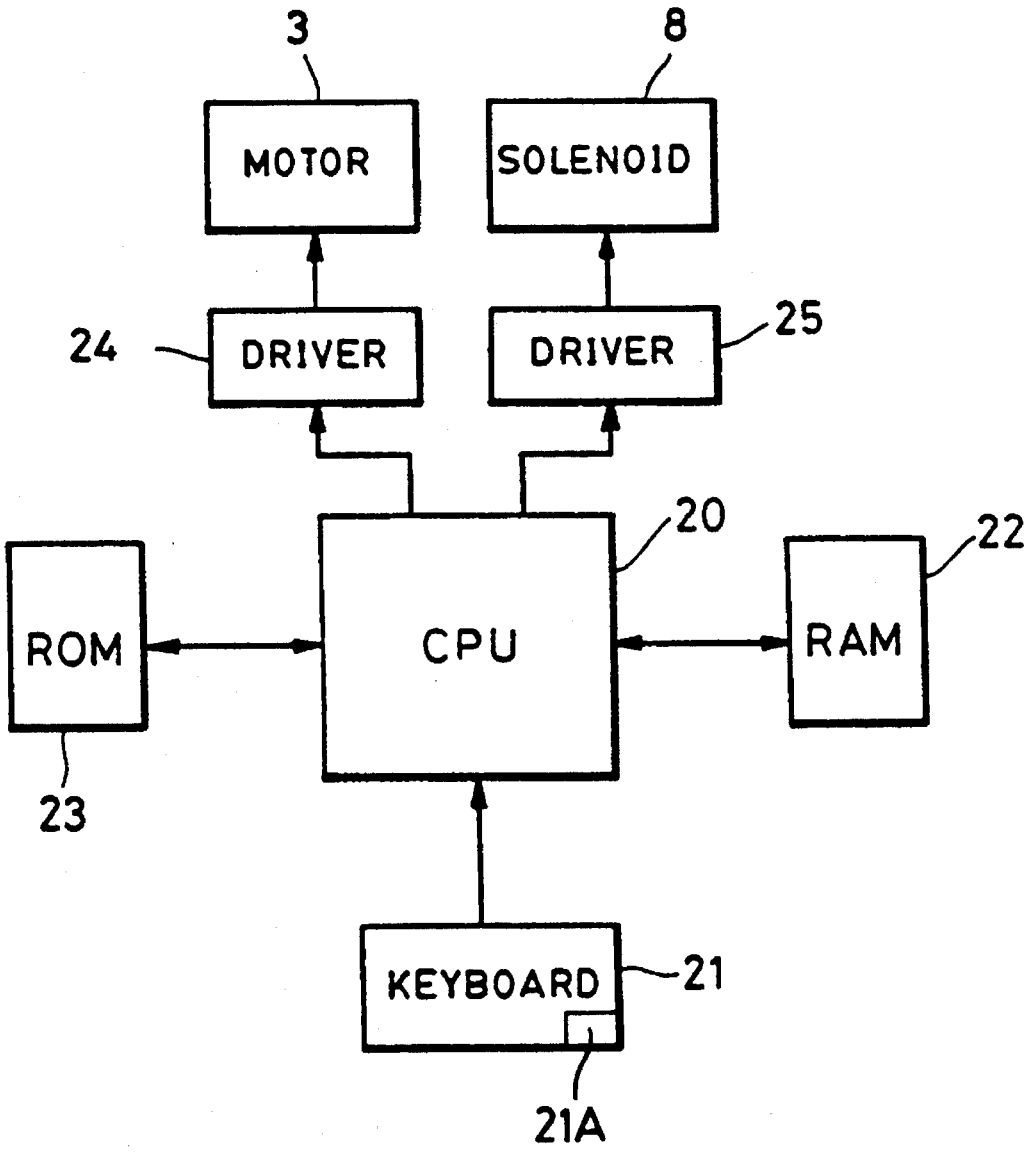
FIG. 3 is a block diagram of the embodiment of the present invention.

FIG. 3 shows a block diagram of this embodiment. A central processing unit (hereinafter referred to as "CPU") 20 operates to temporarily store, in a RAM 22, recording data input from a keyboard 21 and thereafter drive a carriage motor and a hammer 30 or the like on the basis of the contents of a ROM 23, thereby performing printing on a sheet 5A disposed on the platen 5.

The CPU 20 also drives the motor 3 and the solenoid 8 by means of drivers 24 and 25, thereby selectively executing the operation of feeding a sheet 5A or feeding the ribbon.

Figure 4:
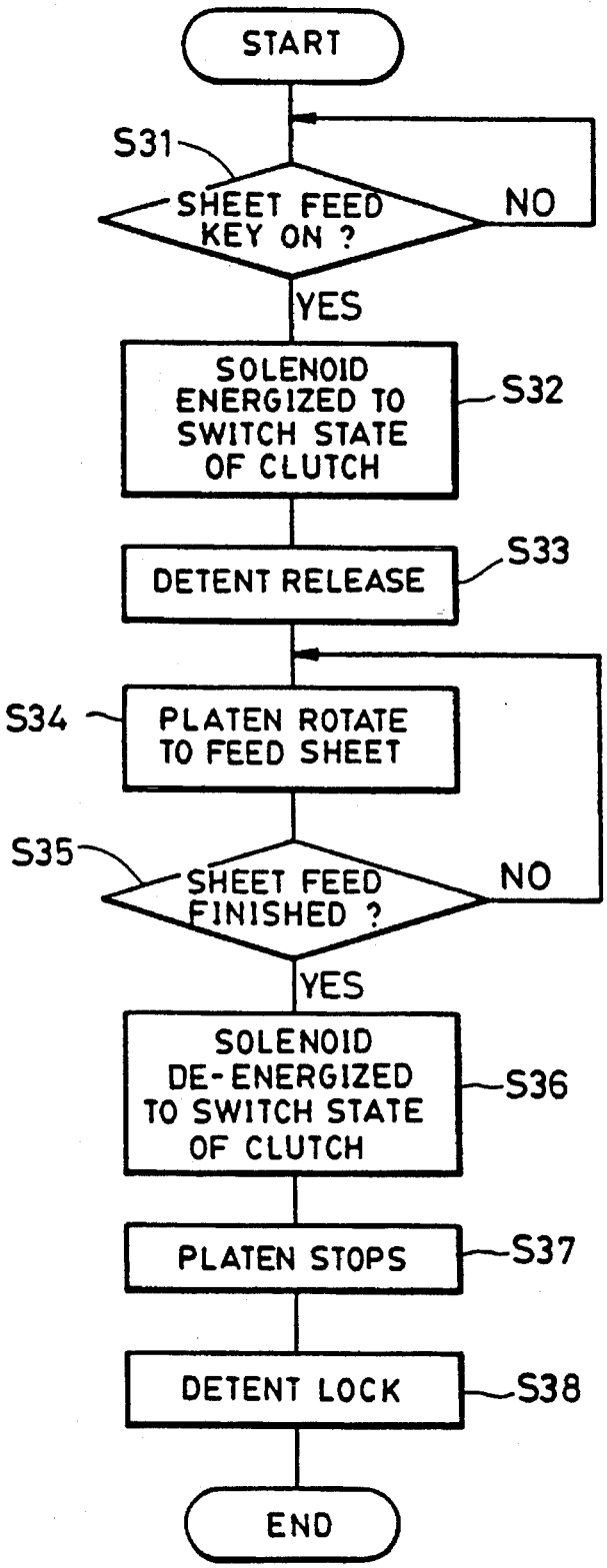
FIG. 4 is a flow chart of the operation procedure in accordance with the embodiment of the present invention.
Figure 5:
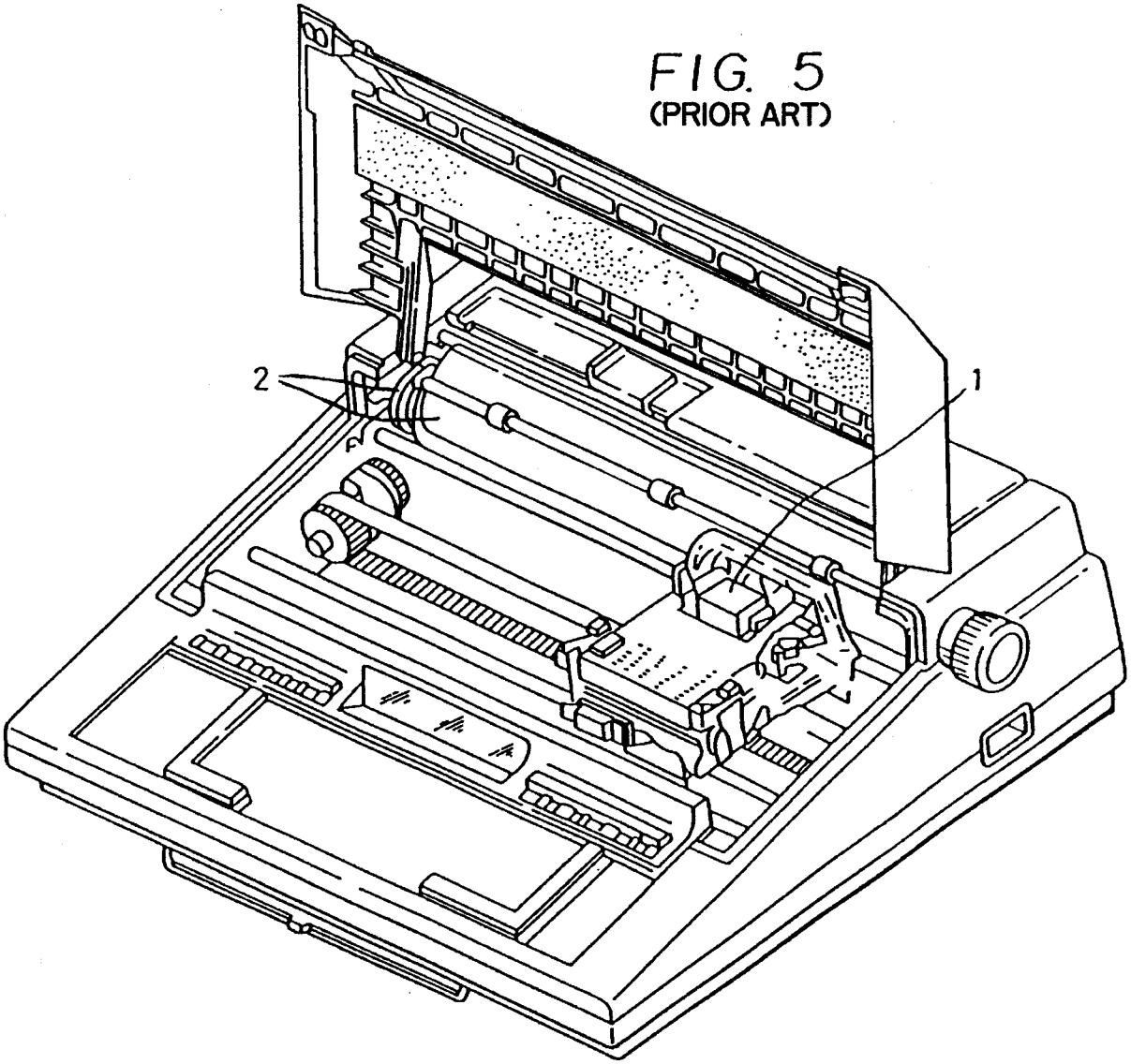
FIG. 5 (PRIOR ART)
FIG. 5 is a perspective view of a typewriter which is an example of a conventional recording apparatus.

FIG. 4 shows a flow chart of the operation of the above-described mechanism at the time of sheet feeding. A program corresponding to this flow chart is stored in the ROM 23 shown in FIG. 3. During printing, that is, while the driving force of the motor 3 is transmitted to the torque shaft 6, the detent lever 11 engages with and stops the platen gear 12 by virtue of the urging force of the spring 11A so that the position of the platen 5 is fixed relative to the direction of rotation thereof.

To feed a sheet 5A, a key 21A in the keyboard 21 shown in FIG. 3 related to a sheet feeding operation is pressed in step S31. In step S32, the solenoid 8 is energized and the clutch 4 is thereby moved against the urging force of the spring 15 in the direction opposite to that indicated by the arrow A so that the clutch gear 4A meshes with the platen gear 12. At the same time, in step S33, the tapered portion 13A of the solenoid lever 13 is brought into contact with the end 11C of the detent lever 11 so that it functions to upwardly move the other end 11B of the lever 11 away from the platen gear 12 by virtue of its tapered shape, thereby releasing the engagement therebetween.

In step S34, the platen 5 is rotated to feed a sheet 5A. If, in step S35, it is determined that the sheet feeding has been completed, the solenoid 8 is de-energized in step S36, thereby allowing the clutch 4 to be operated by the force of the spring 15. The clutch gear 4A is thereby made to mesh with the torque shaft gear 14. Simultaneously, in steps S37 and S38, the end 11C of the detent lever 11 is disengaged from the solenoid lever 13, and the other end 11B is brought into engagement with the platen gear 12 so that it stops the platen 5 and fixes the position thereof.

What is claimed is:

1. A recording apparatus for recording on a recording medium with an ink ribbon, comprising:

recording medium transport means for transporting the recording medium;

ink ribbon transport means for transporting the ink ribbon;

a motor;

a transferable gear;

changeover means for selectively moving said transferable gear between a first position at which said gear transmits a driving force from said motor to said recording medium transport means and a second position at which said gear transmits the driving force from said motor to said ink ribbon transport means;

detent means for inhibiting transportation of the recording medium, said detent means positionable either for effecting detention and prohibiting movement of the recording medium when the driving force is not transmitted to said recording medium transport means or for releasing detention during transportation of said recording medium when the drive force is transmitted to said recording medium transport means; and detent release means for releasing said detent means in response to an operation by said changeover means to move said gear to the first position.

2. A recording apparatus according to claim 1, wherein said recording medium transport means includes a platen roller, and said detent means includes a gear member capable of rotating integrally with said platen roller, and a lever member capable of elastically engaging with said gear member.

3. A recording apparatus according to claim 2, wherein said changeover means includes an operation element operated by a solenoid to release the engagement between said lever member and said gear member.

4. A recording apparatus according to claim 1, wherein said changeover means includes a gear train for transmitting the driving force from said motor to one of said recording medium transport means and said ink ribbon transport means, said gear train including the transferable gear moved by said changeover means to selectively transmit the driving force.

5. A recording apparatus according to claim 4, wherein said changeover means includes a solenoid for moving said transferable intermediate gear.

6. A recording apparatus according to claim 1, further comprising control means for controlling said apparatus, wherein, to feed a recording sheet by actuating said recording medium transport means, said changeover means is actuated by said control means to change the state of transmission from transmission to said ink ribbon transport means to transmission to said recording medium transport means, and said detent means is disengaged from said recording medium transport means, thereafter making said recording medium transport means feed the sheet.

7. A recording apparatus according to claim 6, wherein, after said recording medium transport means has completed transporting the recording medium, said changeover means is actuated by said control means so as to change the state of transmission from transmission to said recording medium transport means to transmission to said ink ribbon transport means, and said detent means is brought into engagement with said recording medium transport means.

8. A recording apparatus according to claim 7, wherein said changeover means includes a solenoid which is energized by said control means when said recording medium transport means feeds said recording medium, and which is de-energized when said recording medium transport means completes the sheet feeding operation.

9. A recording apparatus according to claim 1, further comprising control means and a driver for said motor, wherein said control means and said driver determine a pitch of transportation of said recording medium by controlling said motor.

10. A recording method for recording on a recording medium with an ink ribbon, said method comprising the steps of:

generating a drive force from a motor;

providing a clutch gear movable to a first position for transmitting the drive force to compel movement of the ink ribbon and movable to a second position for transmitting the drive force to compel movement of the recording medium;

prohibiting movement of the recording medium by engagement of a detent mechanism when said clutch gear is in the first position;

releasing detention of the detent mechanism in response to a changeover operation of said drive force when said clutch gear is moved to the second position; and moving said clutch gear between the first and second positions for transporting said ink ribbon and said recording medium with the drive force from said motor.

11. A recording method according to claim 10, further comprising the step of determining a pitch of transportation of said recording medium.

12. A recording apparatus for recording on a recording medium with an ink ribbon, comprising:

a platen;

a platen gear for driving said platen so as to move the recording medium;

ink ribbon transport means for transporting the ink ribbon;

a motor;

changeover means, having a clutch gear, for selectively moving said clutch gear between a first position at which said clutch gear transmits a driving force from said motor to said platen gear and a second position at which said clutch gear transmits a driving force from said motor to said ink ribbon transport means;

a detent lever positionable between an engaged position engaging said platen gear so as to prohibit movement of the recording medium when the driving force is not transmitted to said platen gear and a disengaged position not engaging said platen gear; and detent release means for disengaging said detent lever from said platen gear when said changeover means moves said clutch gear to said first position.

13. A recording apparatus for recording on a recording medium by using an ink ribbon, comprising:

recording medium transport means for transporting the recording medium;

a recording mechanism for recording on the recording medium;

a motor;

a transferrable gear;

changeover means for selectively moving said transferrable gear between a first position at which said gear transmits a driving force from said motor to said recording medium transport means and a second position at which said gear transmits the driving force from said motor to said recording mechanism;

detent means for inhibiting transportation of the recording medium, said detent means positionable either for effecting detention and prohibiting movement of the recording medium when the driving force is not transmitted to said recording medium transport means or for releasing detention during transportation of said recording medium when the drive force is transmitted to said recording medium transport means; and detent release means for releasing said detent means in response to an operation by said changeover means to move said gear to the first position.

14. A recording apparatus according to claim 13, wherein said changeover means includes a gear train for transmitting the driving force from said motor to one of said recording medium transport means and said recording mechanism, said gear train including said transferrable gear moved by said changeover means to selectively transmit the driving force.

15. A recording apparatus according to claim 13, wherein said recording medium transport means includes a platen roller, and said detent means includes a gear member capable of rotating integrally with said platen roller, and a lever member capable of elastically engaging with said gear member.

16. A recording apparatus according to claim 15, wherein said changeover means includes a solenoid for moving said transferrable gear.

17. A recording apparatus according to claim 16, wherein said changeover means includes an operation element operated by said solenoid to release engagement between said lever member and said gear member.

18. A recording apparatus according to claim 13, further comprising control means for controlling said apparatus, wherein, to feed a recording sheet by actuating said recording medium transport means, said changeover means is actuated by said control means to change the state of transmission from transmission to said recording mechanism to transmission to said recording medium transport means, and said detent means is disengaged from said recording medium transport means, thereafter making said recording medium transport means feed the sheet.

19. A recording apparatus according to claim 18, wherein, after said recording medium transport means has completed transferring the recording medium, said changeover means is actuated by said control means so as to change the state of transmission from transmission to said recording medium transport means to transmission to said recording mechanism, and said detent means is brought into engagement with said recording medium transport means.

20. A recording apparatus according to claim 19, wherein said changeover means includes a solenoid which is energized by said control means when said recording medium transport means feeds the recording medium, and which is de-energized when said recording medium transport means completes the sheet feeding operation.

21. A recording apparatus according to claim 13, further comprising control means and a driver for said motor, wherein said control means and said driver determine a pitch of transportation of the recording medium by controlling said motor.

22. A recording apparatus for recording on a recording medium, comprising:

a platen;

a platen gear for driving said platen so as to move the recording medium;

a recording mechanism for recording on the recording medium;

a motor;

changeover means, having a clutch gear, for selectively moving said clutch gear between a first position at which said clutch gear transmits a driving force from said motor to said platen gear and a second position at which said clutch gear transmits a driving force from said motor to said recording mechanism;

a detent lever positionable between an engaged position engaging said platen gear so as to prohibit movement of the recording medium when the driving force is not transmitted to said platen gear and a disengaged position not engaging said platen gear; and detent release means for disengaging said detent lever from the platen gear when said changeover means moves said clutch gear to said first position.

23. A recording apparatus according to claim 22, further comprising control means for controlling said apparatus, wherein to feed a recording sheet by actuating said platen, said changeover means is actuated by said control means to change the state of transmission from transmission to said recording mechanism to transmission to said platen, and said detent lever is disengaged from said platen gear, thereafter making the platen feed the sheet.

24. A recording apparatus according to claim 23, wherein after said platen has completed the sheet supplying operation, said changeover means is actuated so as to change the state of transmission from transmission to said platen to transmission to said recording mechanism, and said detent lever is brought into engagement with said platen gear.

25. A recording apparatus according to claim 24, wherein said changeover means includes a solenoid which is energized by said control means when said platen feeds the recording medium, and which is de-energized when the platen completes the sheet feeding operation.

26. A recording apparatus according to claim 22, further comprising control means and a driver for said motor, wherein said control means and said driver determines a pitch of transportation of the recording medium by controlling said motor.

27. A recording apparatus for recording on a recording medium, comprising:

a first recording mechanism for recording on the recording medium;

a second recording mechanism for recording on the recording medium;

a motor;

changeover means, having a clutch gear, for selectively moving said clutch gear between a first position at which said clutch gear transmits a driving force from said motor to said first recording mechanism and a second position at which said clutch gear transmits a driving force from said motor to said second recording mechanism;

detent means positionable between an engaged position where it engages said first recording mechanism and prohibits operation of said first recording mechanism when the driving force is not transmitted to said first recording mechanism and a disengaged position out of said engagement; and detent release means for disengaging said detent means from said first recording mechanism when said changeover means moves said clutch gear to said first position.

28. A recording apparatus according to claim 27, wherein said detent release means is arranged in said changeover means.

29. A recording apparatus for recording on a recording medium, comprising:

a first recording mechanism for recording on the recording medium;

a second recording mechanism for recording on the recording medium;

drive means for selectively driving said first and second recording mechanisms;

changeover means selectively positionable between a first position at which a driving force is transmitted from said drive means to said first recording mechanism and a second position at which the driving force is transmitted from said drive means to said second recording mechanism;

detent means positionable between an engaged position engaging said first recording mechanism so as to prohibit operation of said first recording mechanism when the driving force is not transmitted to said first recording mechanism and a disengaged position not engaging said first recording mechanism; and detent release means for moving said detent means from said engaged position to said disengaged position in response to movement of said changeover means to said first position.

30. A recording apparatus according to claim 29, wherein said detent release means is arranged in said changeover means.

* * * * *

UNITED STATES PATENT AND TRADEMARK OFFICE

CERTIFICATE OF CORRECTION

PATENT NO. : 5,482,388

DATED : January 9, 1996

INVENTOR(S) : TSUTOMU HARADA

It is certified that error appears in the above-indentified patent and that said Letters Patent is hereby corrected as shown below:

ON THE COVER PAGE

Item: [56] References Cited

FOREIGN PATENT DOCUMENTS

"60-202868 9/1986 Japan" should read --61-202868 9/1986 Japan--.

COLUMN 1

Line 47, "ay" should read --may--.

Signed and Sealed this

Twenty-first Day of May, 1996

Bruce Lehman

*Attest:*

BRUCE LEHMAN

*Attesting Officer*

*Commissioner of Patents and Trademarks*